US008820072B2

(12) United States Patent
Figura et al.

(10) Patent No.: US 8,820,072 B2
(45) Date of Patent: Sep. 2, 2014

(54) COMPRESSOR DIFFUSER PLATE

(75) Inventors: Giorgio Figura, Epinal (FR); Parikshit I Mulani, Pune (IN); Poomkuzhimannil Zachariah John, Epinal (FR); Shajeev Surendran, Bangalore (IN); T. G. Vijayan, Pune (IN)

(73) Assignee: Honeywell International Inc., Morristown, NJ (US)

( * ) Notice: Subject to any disclaimer, the term of this patent is extended or adjusted under 35 U.S.C. 154(b) by 386 days.

(21) Appl. No.: 13/215,999

(22) Filed: Aug. 23, 2011

(65) Prior Publication Data

US 2013/0051973 A1 Feb. 28, 2013

(51) Int. Cl.

| | |
|---|---|
| ***F02B 33/44*** | (2006.01) |
| ***F01D 5/00*** | (2006.01) |
| ***F01D 25/04*** | (2006.01) |
| ***F04D 29/44*** | (2006.01) |
| ***F01D 17/08*** | (2006.01) |
| ***F04D 27/00*** | (2006.01) |
| ***F04D 29/46*** | (2006.01) |
| ***B32B 27/00*** | (2006.01) |

(52) U.S. Cl.

CPC ..... *F04D 29/441* (2013.01); *F05B 2220/40* (2013.01); *F05B 2280/10723* (2013.01)

USPC .... 60/605.1; 415/119; 415/199.2; 415/208.3; 415/159; 415/164; 428/423.5

(58) Field of Classification Search

CPC ..... F04D 29/441; F05B 2220/40; F05B 2280/10723

USPC ..... 60/605.1; 415/208.3, 207, 211.1, 224.5, 415/135–136, 126, 128, 119, 159, 164, 415/199.1, 199.2; 424/646; 181/286; 428/423.5

IPC ..... F02B 39/00; F04D 17/08,27/00, 29/46

See application file for complete search history.

(56) References Cited

U.S. PATENT DOCUMENTS

| | | | | |
|---|---|---|---|---|
| 4,770,605 | A * | 9/1988 | Nakatomi | 415/208.3 |
| 5,456,577 | A * | 10/1995 | O'Sullivan et al. | 415/199.2 |
| 6,550,574 | B2 * | 4/2003 | Liu | 181/286 |
| 6,568,904 | B1 * | 5/2003 | Ueyama et al. | 415/199.2 |
| 6,669,436 | B2 * | 12/2003 | Liu | 415/1 |

(Continued)

FOREIGN PATENT DOCUMENTS

| | | | | |
|---|---|---|---|---|
| JP | 62118100 A | * | 5/1987 | F04D 29/46 |
| JP | H3-50328 A | | 3/1991 | |

(Continued)

OTHER PUBLICATIONS

SPIROL Disc Springs, Spirol International Corporation, May 2011 (10 pages).

*Primary Examiner* — Thai Ba Trieu

(74) *Attorney, Agent, or Firm* — Brian J. Pangrle

(57) ABSTRACT

A diffuser plate for a centrifugal compressor includes an inner edge disposed at an inner diameter about a central axis; an outer edge disposed at an outer diameter, the outer edge displaced an axial distance from the inner edge; a deformable section that includes a substantially S-shaped cross-section, the deformable section disposed between the inner edge and the outer edge; and a spring constant for forced axial displacement of the outer edge with respect to the inner edge, the spring constant characterized, at least in part, by the deformable section.

17 Claims, 10 Drawing Sheets

(56) References Cited

U.S. PATENT DOCUMENTS

| | | | | |
|---|---|---|---|---|
| 6,918,740 | B2 * | 7/2005 | Liu | 415/1 |
| 7,367,190 | B2 | 5/2008 | Shibui et al. | |
| 7,478,991 | B2 * | 1/2009 | Noelle | 415/159 |
| 7,531,238 | B2 * | 5/2009 | Mizuno et al. | 428/423.5 |
| 7,553,127 | B2 * | 6/2009 | Noelle | 415/164 |
| 8,142,148 | B2 * | 3/2012 | Hernandez et al. | 415/208.3 |
| 2003/0161717 | A1 * | 8/2003 | Liu | 415/1 |
| 2004/0146396 | A1 * | 7/2004 | Liu | 415/119 |
| 2007/0207030 | A1 * | 9/2007 | Noelle | 415/160 |
| 2007/0286716 | A1 * | 12/2007 | Noelle | 415/150 |
| 2008/0152727 | A1 * | 6/2008 | Yamada et al. | 424/646 |
| 2009/0214333 | A1 * | 8/2009 | Hernandez et al. | 415/203 |
| 2011/0041494 | A1 * | 2/2011 | Parker et al. | 60/605.1 |
| 2012/0111002 | A1 * | 5/2012 | Tabata | 415/148 |

FOREIGN PATENT DOCUMENTS

| | | | | |
|---|---|---|---|---|
| JP | 2000213496 | A * | 8/2000 | F04D 29/46 |
| JP | 2012202324 | A * | 10/2012 | F04D 29/46 |
| SU | 1339302 | A1 * | 9/1987 | F04D 17/08 |
| WO | 2006126993 | A1 | 11/2006 | |

* cited by examiner $Q = h*A*\Delta T$
q = heat flow in input or lost heat flow, J/s = W
h = heat transfer coefficient, $W/(m^2K)$
A = heat transfer surface area, $m^2$
$\Delta T$ = difference in temperature between the solid surface and surrounding fluid area, K

COMPRESSOR DIFFUSER PLATE

TECHNICAL FIELD

Subject matter disclosed herein relates generally to turbomachinery for internal combustion engines and, in particular, to compressor diffuser plates and assemblies.

BACKGROUND

Centrifugal compressors typically include a compressor wheel to direct fluid to a diffuser and, subsequently, to a volute. Often a diffuser is defined by surfaces of two components such as a surface of a compressor housing and a surface of a compressor backplate. For turbochargers, a compressor backplate may be a component attached to a center housing or be configured as an integral feature of a center housing. In either instance, during operation, heat energy flows from exhaust directed to a turbine through the center housing and on to the compressor, which, in turn, can increase temperature of fluid passing through the compressor. In general, an increase in temperature causes a decrease in compressor efficiency. Further, where a turbocharged internal combustion engine is operated using exhaust gas recirculation (EGR), in various arrangements, exhaust is directed upstream of the compressor. Such EGR arrangements can be detrimental to compressor and related components.

Various technologies described herein pertain to assemblies that include a diffuser plate to, for example, enhance compressor performance and longevity, particularly where an assembly is exposed to heat and constituents carried by exhaust.

BRIEF DESCRIPTION OF THE DRAWINGS

A more complete understanding of the various methods, devices, assemblies, systems, arrangements, etc., described herein, and equivalents thereof, may be had by reference to the following detailed description when taken in conjunction with examples shown in the accompanying drawings where.

DETAILED DESCRIPTION

Figure 1:
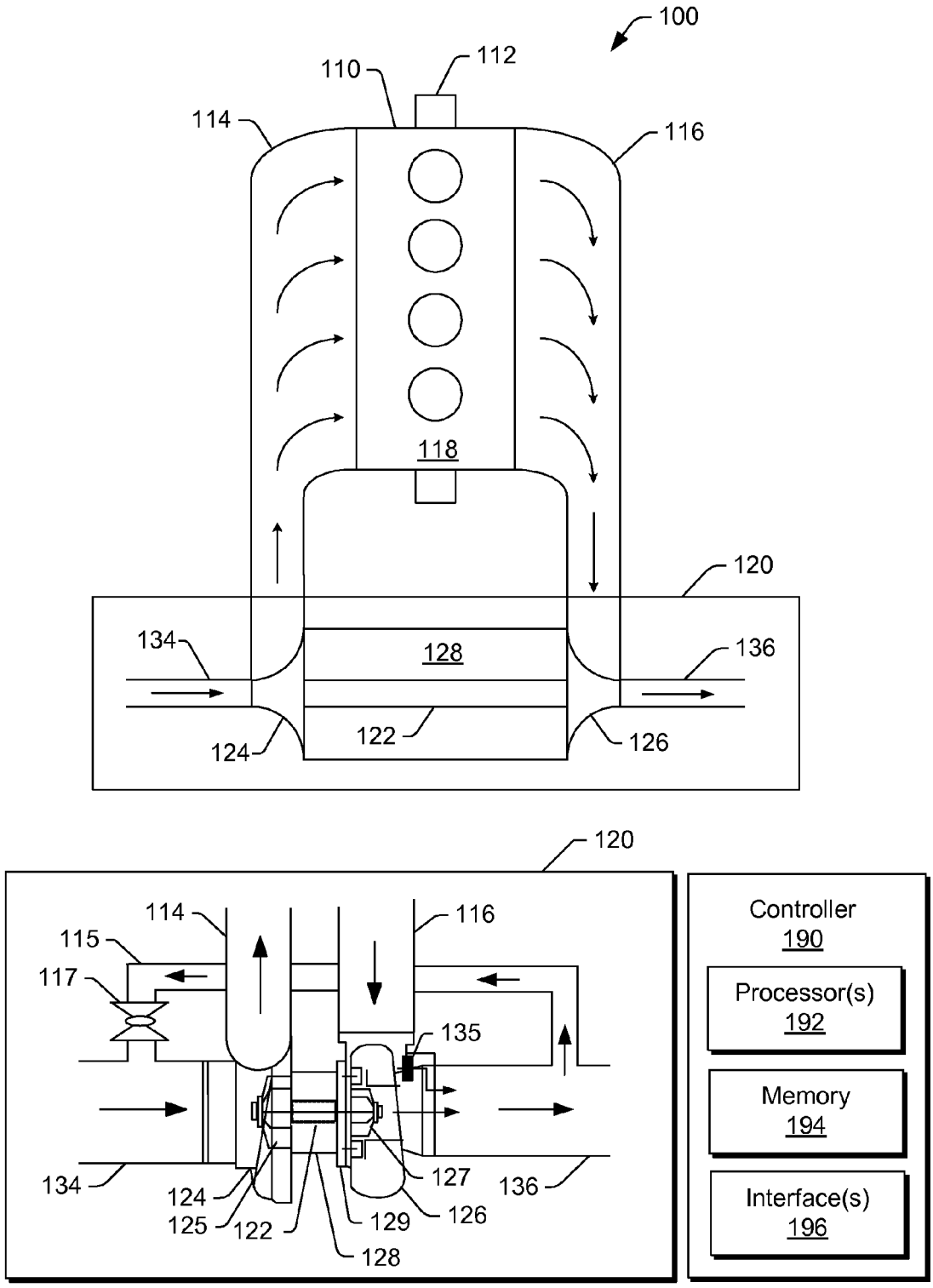
FIG. 1 is a diagram of a turbocharger and an internal combustion engine along with a controller.

Various examples are presented herein that pertain to a deformable diffuser plate, which may be positioned between components of a compressor assembly. Such a plate may include an inner edge disposed at an inner diameter about a central axis; an outer edge disposed at an outer diameter, the outer edge displaced an axial distance from the inner edge; a deformable section disposed between the inner edge and the outer edge; and a spring constant for forced axial displacement of the outer edge with respect to the inner edge where the spring constant is characterized, at least in part, by the deformable section.

With respect to spring characteristics of a diffuser plate, equations that define so-called disc springs may be referenced (e.g., as provided by DIN standards). In various examples described herein, a diffuser plate can optionally include a fulcrum contact surface; noting that, for conventional disc springs, contact typically occurs at an inner edge and outer edge only. Accordingly, equations that describe behavior of conventional disc springs may require some alterations to apply to a diffuser plate deformed about a fulcrum contacting a fulcrum contact surface.

As described herein, in an uncompressed (undeformed) state, a diffuser plate has a shape that may be inadequate for defining a diffuser in that it acquires an adequate shape only upon compression (deformation). In various examples, a deformable diffuser plate includes a deformable section with a substantially S-shaped cross-section disposed between an inner edge and an outer edge of the plate. Such a section may be positioned to accommodate a compressor wheel, particularly an outer edge of a compressor wheel. For example, an S-shaped section of a plate may be a transition that rises axially in a manner that provides for clearance between the plate and a compressor wheel. In such an example, the shape of the plate acts, at least in part, to shape a diffuser (e.g., in conjunction with a contoured surface of a compressor housing).

In various examples, a diffuser plate can provide for one or more gaps (e.g., air gaps) that act to hinder heat transfer. In general, during operation of a turbocharger, heat energy from exhaust is transferred to a compressor, which can decrease compressor efficiency. Accordingly, a diffuser plate that provides for one or more gaps (or pockets) between components can reduce transfer of heat energy to a compressor (e.g., along diffuser flow paths, volute flow paths, etc.).

As described herein, a diffuser plate may be constructed from a material or materials that provide for any of a variety of characteristics. A material of construction may be, for example, stainless steel, or other material, capable of being formed into a shape having sufficient stiffness (e.g., characterized by a modulus of elasticity). In various examples, shape and stiffness of a diffuser plate may allow for spring action to apply a pre-load to a joint (e.g., a bolted joint). A material may be optionally applied to a surface or formed on a surface. As described herein, a treatment process may treat a diffuser plate (e.g., at least a portion of a plate) to provide for characteristics that act to repel oil, reduce corrosion, alter heat transfer, alter boundary layer formation, etc. For example, a sol-gel process may deposit a sol-gel layer (e.g., consider a metal oxide) on a surface of a diffuser plate where the sol-gel layer provides for one or more beneficial characteristics (e.g., hydrophilicity to repel hydrophobic chemicals). As another example, consider electroless nickel deposition or plating. Electroless nickel plating (EN plating) is an auto-catalytic chemical technique used to deposit a layer of a material such as nickel-phosphorus or nickel-boron alloy on a surface. As yet another example, a super finishing technique may be used to provide a diffuser plate with a super finish (e.g., a nano-finish) that helps to prevent corrosion, fouling, deposit formation, etc.

As described herein, a treatment may generally be applied prior to installation but may optionally be applied after installation (e.g., clamping) of a diffuser plate (e.g., by flowing treatment fluid, applying electrical charge, etc.). Further, a treatment may be applied to a portion of the diffuser plate based on amount of deformation. For example, if a treatment renders a surface sensitive to cracking, such a treatment may be applied over a portion of a diffuser plate that experiences minimal deformation. Yet further, a material may be applied via a treatment and then finished (e.g., polished, etc.) to provide for desirable flow characteristics or other characteristics. As described herein, a diffuser plate may be color coded, labeled, etc., for example, to facilitate proper assembly (e.g., blue dot to indicate diffuser side and red dot to indicate center housing side).

Below, an example of a turbocharged engine system is described followed by various examples of components, assemblies, methods, etc.

Turbochargers are frequently utilized to increase output of an internal combustion engine. Referring to FIG. 1, a conventional system 100 includes an internal combustion engine 110 and a turbocharger 120. The internal combustion engine 110 includes an engine block 118 housing one or more combustion chambers that operatively drive a shaft 112 (e.g., via pistons). As shown in FIG. 1, an intake port 114 provides a flow path for air to the engine block 118 while an exhaust port 116 provides a flow path for exhaust from the engine block 118.

Also shown in FIG. 1, the turbocharger 120 includes an air inlet 134, a shaft 122, a compressor 124, a turbine 126, a housing 128 and an exhaust outlet 136. The housing 128 may be referred to as a center housing as it is disposed between the compressor 124 and the turbine 126. The shaft 122 may be a shaft assembly that includes a variety of components. In operation, the turbocharger 120 acts to extract energy from exhaust of the internal combustion engine 110 by passing the exhaust through the turbine 126. As shown, rotation of a turbine wheel 127 of the turbine 126 causes rotation of the shaft 122 and hence a compressor wheel 125 (e.g., impeller) of the compressor 124 to compress and enhance density of inlet air to the engine 110. By introducing an optimum amount of fuel, the system 100 can extract more specific power out of the engine 100 (e.g., compared to a non-turbocharged engine of the same displacement). As to control of exhaust flow, in the example of FIG. 1, the turbocharger 120 includes a variable geometry unit 129 and a wastegate valve 135. The variable geometry unit 129 may act to control flow of exhaust to the turbine wheel 127. The wastegate valve (or simply wastegate) 135 is positioned proximate to the inlet of the turbine 126 and can be controlled to allow exhaust from the exhaust port 116 to bypass the turbine wheel 127.

Further, to provide for exhaust gas recirculation (EGR), such a system may include a conduit to direct exhaust to an intake path. As shown in FIG. 1, the exhaust outlet 136 can include a branch 115 where flow through the branch 115 to the air inlet path 134 may be controlled via a valve 117. In such an arrangement, exhaust may be provided upstream the compressor 124; accordingly, exhaust will contact the various components of the compressor 124. In some extreme operational conditions (e.g., during so-called low-pressure EGR engine operation), engine exhaust gas and associated constituents (e.g., acidic constituents) can enter a compressor stage of the turbocharger 120. Presence of such constituents can cause corrosion of, for example, an exposed center housing portion, or cause fouling, for example, by deposition of residual oil on a center housing diffuser surface. Such detrimental processes can diminish compressor stage efficiency, particularly where they lead to increases in temperature (e.g., whether by increased friction, alteration in heat transfer, or other phenomena). Further, increased temperature may cause coking or other reactions that may act to fix deposits.

More generally, EGR is an established method of reducing NOx in internal combustion engines, for example, by reducing peak cylinder combustion temperature (e.g., rate of combustion) as well as reducing partial oxygen pressure in a combustion cylinder. As mentioned, EGR can involve diverting a fraction of the exhaust gas into an intake manifold where the re-circulated exhaust gas mixes with incoming air before being inducted into a combustion cylinder. Other techniques to achieve EGR can involve valve control, for example, where an exhaust valve for a combustion cylinder is operated to retain at least some exhaust gas.

Two techniques that rely on recirculation via a pathway or pathways are so-called high pressure EGR and low pressure EGR. High pressure EGR is sometimes referred to as "short route" EGR (SREGR) while low pressure EGR is sometimes referred to as "long route" EGR (LREGR). Referring again to FIG. 1, as recirculated exhaust enters the conduit 115 downstream from the turbine 126, it has a "low pressure" compared to exhaust upstream from the turbine 126. In a SREGR arrangement, exhaust upstream from the turbine 126 may have sufficiently high pressure to be directed to the intake 114 downstream from the compressor 124. Notably, in such an arrangement, it would be rare for exhaust to flow in an opposite direction and contact the compressor 124. Accordingly, as LREGR involves providing exhaust upstream from a compressor, it can raise issues as to erosion, corrosion, durability, etc., of compressor and related components. For example, oil from seal blow-by (e.g., engine, turbocharger or both) and soot particulates may deposit on a compressor or related surface where they may burn and foul the surface. As another example, consider exhaust gas contributing to acidic conditions, which may cause corrosion on a compressor or related surface. Accordingly, various aspects of LREGR can lead to reductions in compressor efficiency.

To address issues associated with LREGR, some systems have included coolers, filters or other equipment. For example, to address heat, a cooler may extract heat from exhaust prior to entry of the exhaust upstream from a compressor. Similarly, to remove at least some contaminants (e.g., particulates), a filter may be positioned along a LGEGR pathway. As described herein, a diffuser plate may be used to reduce at least some detrimental aspects of LGEGR. As described herein, a diffuser plate may optionally be implemented in conjunction with an exhaust cooler, an exhaust filter, etc.

In FIG. 1, an example of a controller 190 is shown as including one or more processors 192, memory 194 and one or more interfaces 196. Such a controller may include circuitry such as circuitry of an engine control unit. As described herein, various methods or techniques may optionally be implemented in conjunction with a controller, for example, through control logic. Control logic may depend on one or more engine operating conditions (e.g., turbo rpm, engine rpm, temperature, load, lubricant, cooling, etc.). For example, sensors may transmit information to the controller 190 via the one or more interfaces 196. Control logic may rely on such information and, in turn, the controller 190 may output control signals to control engine operation. The controller 190 may be configured to control lubricant flow, temperature, a variable geometry assembly (e.g., variable geometry compressor or turbine), a wastegate, an exhaust gas recirculation valve, an electric motor, or one or more other components associated with an engine, a turbocharger (or turbochargers), etc. Where a system includes LREGR and SREGR, such a controller may be configured to select and operate either or both to achieve a desired outcome. Further, where a system includes valves capable of being controlled for timing, lift, etc., as to exhaust retention, the controller 190 may be configured to achieve a desired exhaust retention, optionally on a cylinder-by-cylinder basis.

Figure 2:
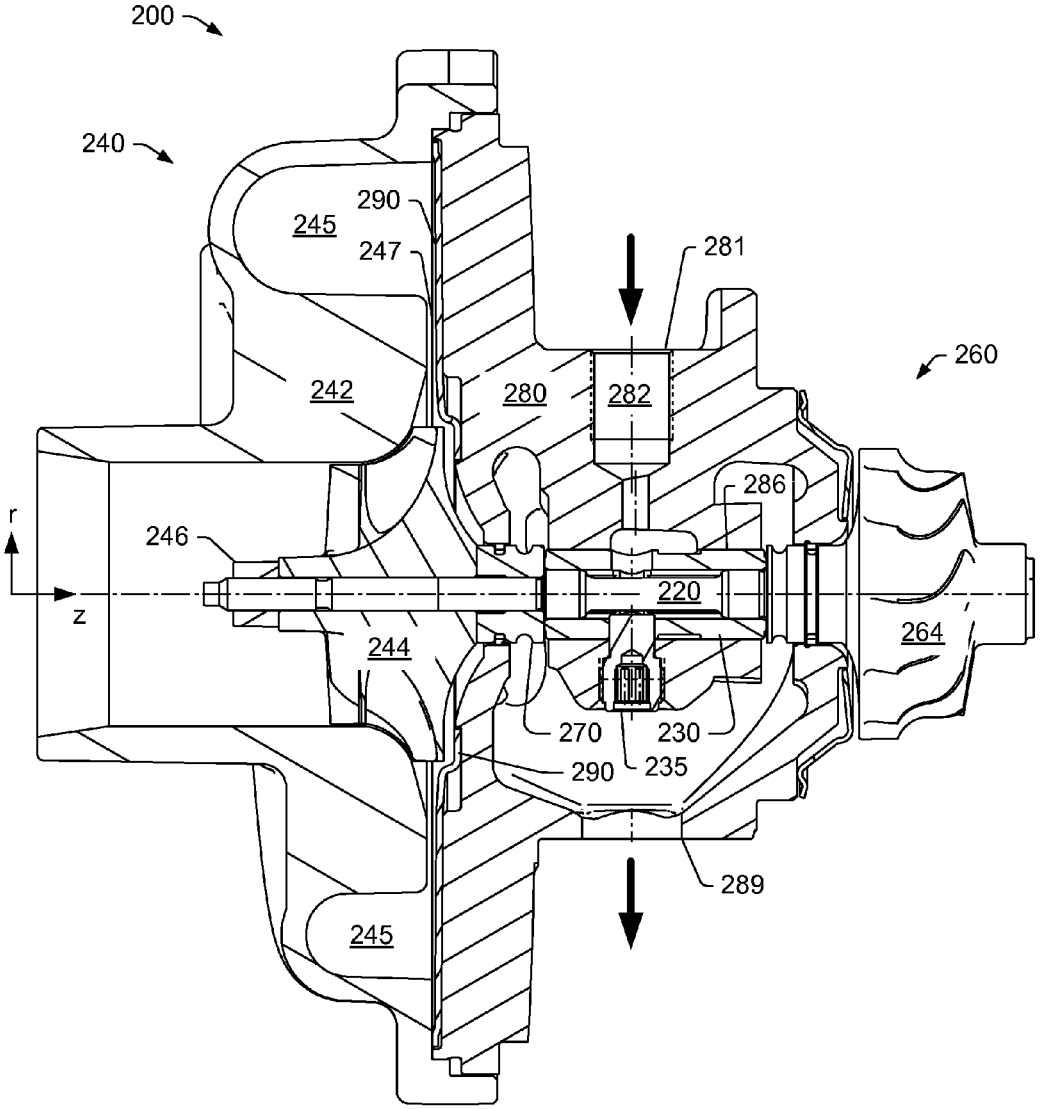
FIG. 2 is a cross-sectional view of an example of a turbocharger assembly that includes an example of a diffuser plate.

FIG. 2 shows an example of a turbocharger assembly 200 that includes a shaft 220 supported by a bearing 230 disposed in a bearing housing 280 between a compressor 240 and a turbine 260. In the example of FIG. 2, the assembly 200 also includes a locating pin 235 received by the bearing 230 and a thrust collar 270 disposed in a bore at a compressor side of the bearing housing 280.

The compressor 240 includes a compressor housing 242 that defines a volute 245 and that houses a compressor wheel 244 secured to the shaft 220 by a nut 246. Further, a diffuser plate 290 is shown as being clamped between the compressor housing 242 and the bearing housing 280 to define, at least in part, a surface of a diffuser 247. In FIG. 2, the turbine 260 is shown as including a turbine wheel 264. As described herein, the bearing housing 280 or the compressor housing 242 may be assemblies assembled from various components. For example, the bearing housing 280 may optionally include a compressor side component (e.g., consider a component configured as a backplate and including a recess to seat the diffuser plate 290).

In the example of FIG. 2, the bearing housing 280 includes a lubricant inlet 281 and a lubricant outlet 289. Lubricant flows from the inlet 281 to the outlet 289 via a bore 282 that directs lubricant to a chamber that opens along an axial bore 286 of the bearing housing 280. As shown, the outlet 289 collects lubricant that flows through or around the bearing 230, which may be cooled, filtered, etc., and eventually recirculated to the inlet (e.g., via a lubricant pump of an internal combustion engine). To assist with flow of lubricant, the inlet 281 and the outlet 289 may be aligned with gravity.

Figure 3:
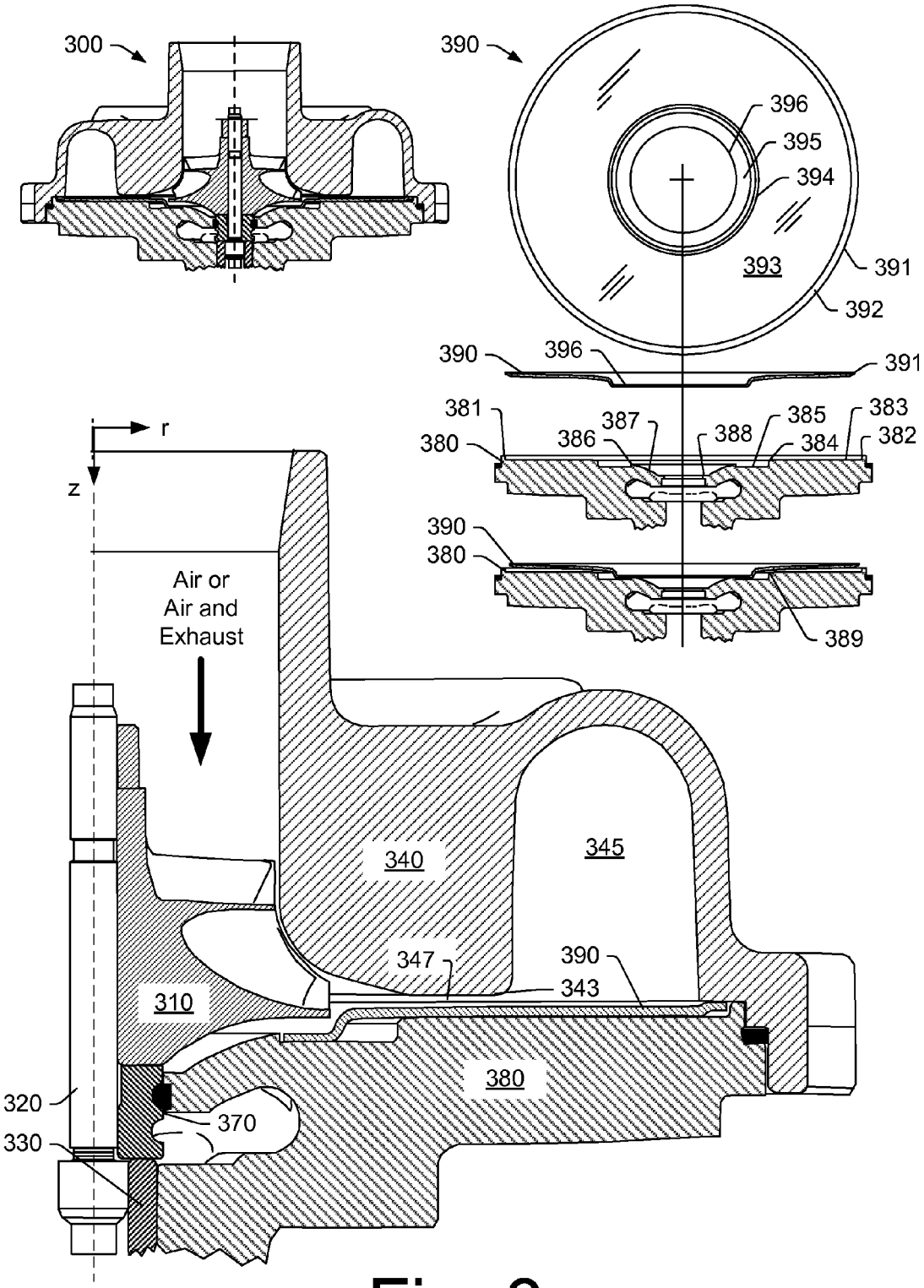
FIG. 3 is a series of views of an example of an assembly that includes an example of a diffuser plate.

FIG. 3 shows various views of an example of an assembly 300 and some components thereof. In an enlarged cross-sectional view, a diffuser plate 390 is shown as being clamped between a compressor housing 340 and a center housing 380. Clamping of the two housings may occur via any of a variety of mechanisms. For example, a ring, bolts, clips, etc., may provide for attaching the two housing to each other in a manner to thereby clamp the diffuser plate 390 therebetween. Also shown in the enlarged cross-sectional view are a compressor wheel 310, a shaft 320, a bearing 330, and a collar 370.

During operation, rotation of the wheel 310 acts to compress and direct air (e.g., or air and exhaust) to a diffuser 347 defined in part by a surface 343 of the housing 340 and subsequently to a volute 345 defined in part by the compressor housing 340. In the example of FIG. 3, the diffuser plate 390 extends from a radius less than the outer radius of the wheel 310 to a radius greater than the outer radius of the volute 345. Accordingly, the diffuser plate 390 provides a surface that defines, in part, the diffuser 347 and, in part, the volute 345. In such a configuration, the diffuser plate 390 substantially covers a portion of the center housing 380 that would otherwise be exposed to fluid passing through the diffuser 347 and the volute 345. As described herein, a diffuser plate 390 can act, for example, to protect a surface of a housing from fouling, protect a surface of a housing from corrosion, reduce heat transfer from a housing, etc.

In a top view of the diffuser plate 390, an outer edge 391, a raised annular section 392, an intermediate section 393, a transition section 394, a lower annular section 395 and an inner edge 396 are shown. A cross-sectional view of the diffuser plate 390 shows the plate in an uncompressed (undeformed) state.

Just below the cross-sectional view of the diffuser plate 390, a cross-sectional view of a portion of the center housing 380 shows a recess defined by a raised annular ridge 381, an outer edge 382 that transitions to an annular surface 383, a transition 384 to a lower annular surface 385, an inner edge 386 that rises to a contoured annular surface 387 that terminates at an edge 388 disposed at an inner diameter (e.g., to define a bore configured to cooperate with the collar 370). As shown in the example of FIG. 3, the recess includes a fulcrum 389, which may be an annular surface configured to contact a fulcrum contact surface of the diffuser plate 390, for example, upon placement of the diffuser plate 390 in the recess or upon compression of the plate (e.g., by clamping the plate between two components).

In a cross-sectional view that shows the diffuser plate 390 in an uncompressed state set in the recess of the center housing 380, the fulcrum 389 does not contact the plate 390. In such an example, some compression of the plate 390 may occur before contact with the fulcrum 389 (e.g., free deformation). Upon contact with the fulcrum 389, the compression dynamics of the diffuser plate 390 are altered. As described herein, a component may include one or more fulcrums for interacting with a diffuser plate, for example, to shape the plate, to provide for biasing characteristics, to provide for an air gap or pocket, etc.

As mentioned, any of a variety of mechanisms may be employed to attach components to clamp a diffuser plate. As described herein, a diffuser plate can provide a pre-load force to bias a clamping force. Such an arrangement may allow for a reduction in, for example, number of bolts to attach a compressor housing to another housing as a diffuser plate can distribute force more evenly about a circumference. Further, a diffuser plate may provide for sealing about a circumference, which would otherwise be achieved solely by tightening bolts or another mechanism to ensure contact between housings. As an example, consider an arrangement with two housings configured to receive three bolts spaced at about 120 degree intervals where tightening of the bolts clamps a diffuser plate that forms a seal between the two housings. Yet further, since a diffuser plate can act as a spring, it can help to retain the clamping load on a compressor housing. As described herein, stiffness and shape of a diffuser plate can be optimized to ensure that a bolt retained load is enhanced (e.g., where spring action assists a bolt retention load).

Figure 4:
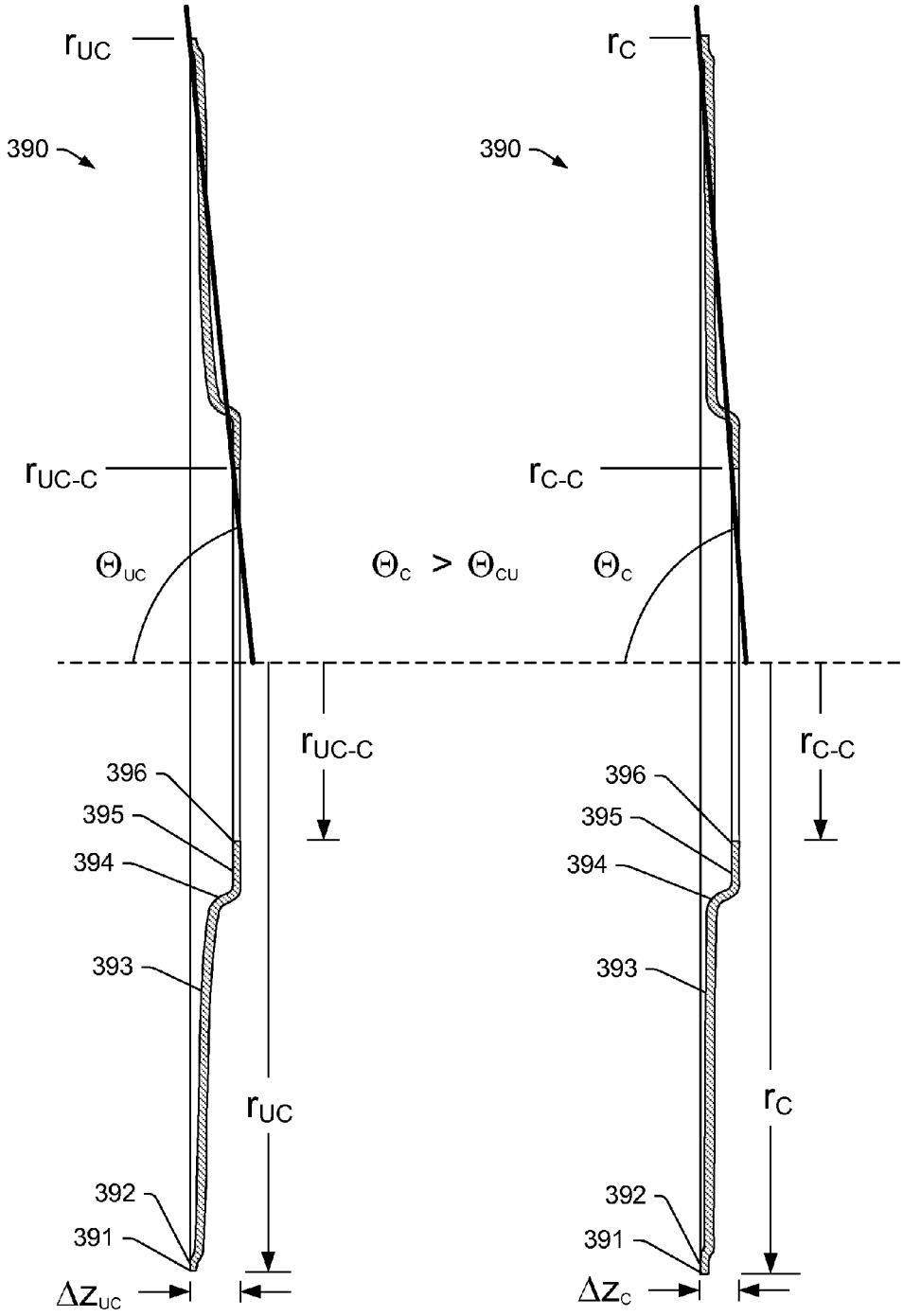
FIG. 4 is a series of views of an example of the diffuser plate of FIG. 3 in an uncompressed state and a compressed state.

FIG. 4 shows an uncompressed cross-sectional view and a compressed cross-sectional view of the diffuser plate 390 of FIG. 3 along with various dimensions. For a cylindrical coordinate system with an axial coordinate z (z-axis) and a radial coordinate r, in an uncompressed state the plate 390 has an axial height $\Delta z_{UC}$ while in a compressed state the plate 390 has an axial height $\Delta z_C$. In general, the plate 390 is compressible by fixing a surface and applying force to another surface. For example, a surface of the lower annular section 395 may be fixed (e.g., in contact with a housing) and force applied to a surface of the raised annular section 392. Again, as mentioned, where a fulcrum is provided, the plate 390 may contact the fulcrum at a fulcrum contact point, points or surface (e.g., located between the inner edge 396 and the outer edge 391), which, in turn, will alter the shape of the plate 390 responsive to application of force sufficient to diminish its axial height (e.g., consider axial distance between the outer edge 391 and the inner edge 396).

As shown in FIG. 4, radial dimensions of the plate 390 include a radius of the outer edge 391 and a radius of the inner edge 396. In general, the radius of the outer edge 391 may be slightly larger for the plate 390 in a compressed state ($r_C$) when compared to an uncompressed state ($r_{UC}$). Such a difference may be characterized, at least in part, by an angle Θ, defined at a central axis (z-axis) by a line passing through a point on the inner edge 396 and a point on the outer edge 391. For the example of FIG. 4, the compressed angle $\Theta_C$ is greater than the uncompressed angle $\Theta_{UC}$ (e.g., the compressed angle is closer to being perpendicular to the z-axis). As for the inner edge 396, its radius may change slightly upon compression (e.g., $r_{UC-C}$ not equal to $r_{C-C}$).

An approximate equation for spring characteristics of a diffuser plate may be $F=-k\Delta z$, where z is an axial dimension and k is a spring constant. Where a fulcrum is used to shape a diffuser plate, the plate may optionally be characterized by more than one spring constant, according to the approximate equation. For example, a diffuser plate may have a spring constant for free deformation and another spring constant for deformation with respect to a fulcrum contact surface.

While the example of FIG. 4 shows the plate 390 as having a substantially uniform thickness, as described herein, a plate may include a varying thickness, which, in turn, may provide for beneficial characteristics (e.g., spring characteristics, wear characteristics, fit characteristics, etc.).

Figure 5:
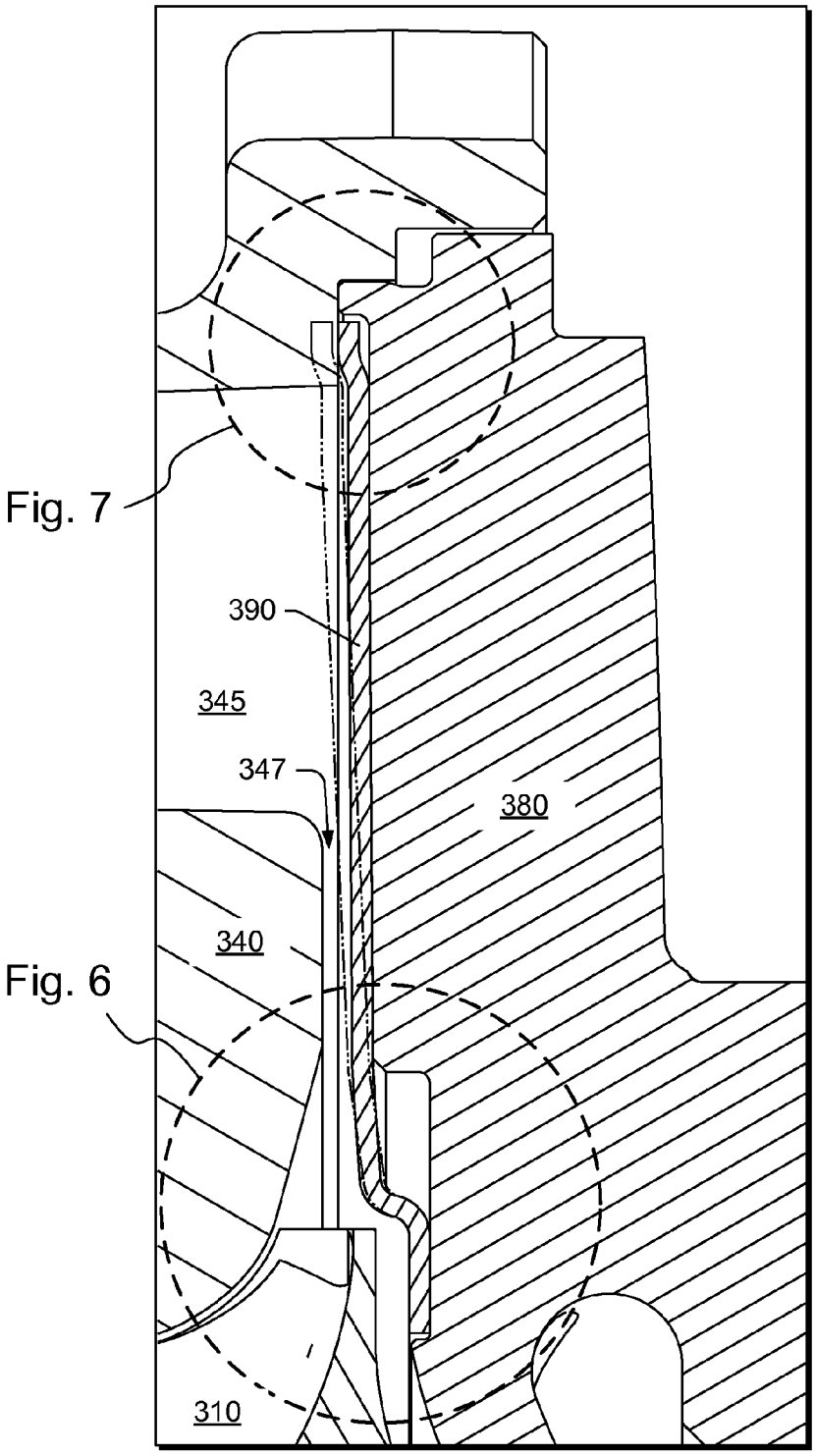
FIG. 5 is a cross-sectional view of a portion of the assembly of FIG. 3.
Figure 6:
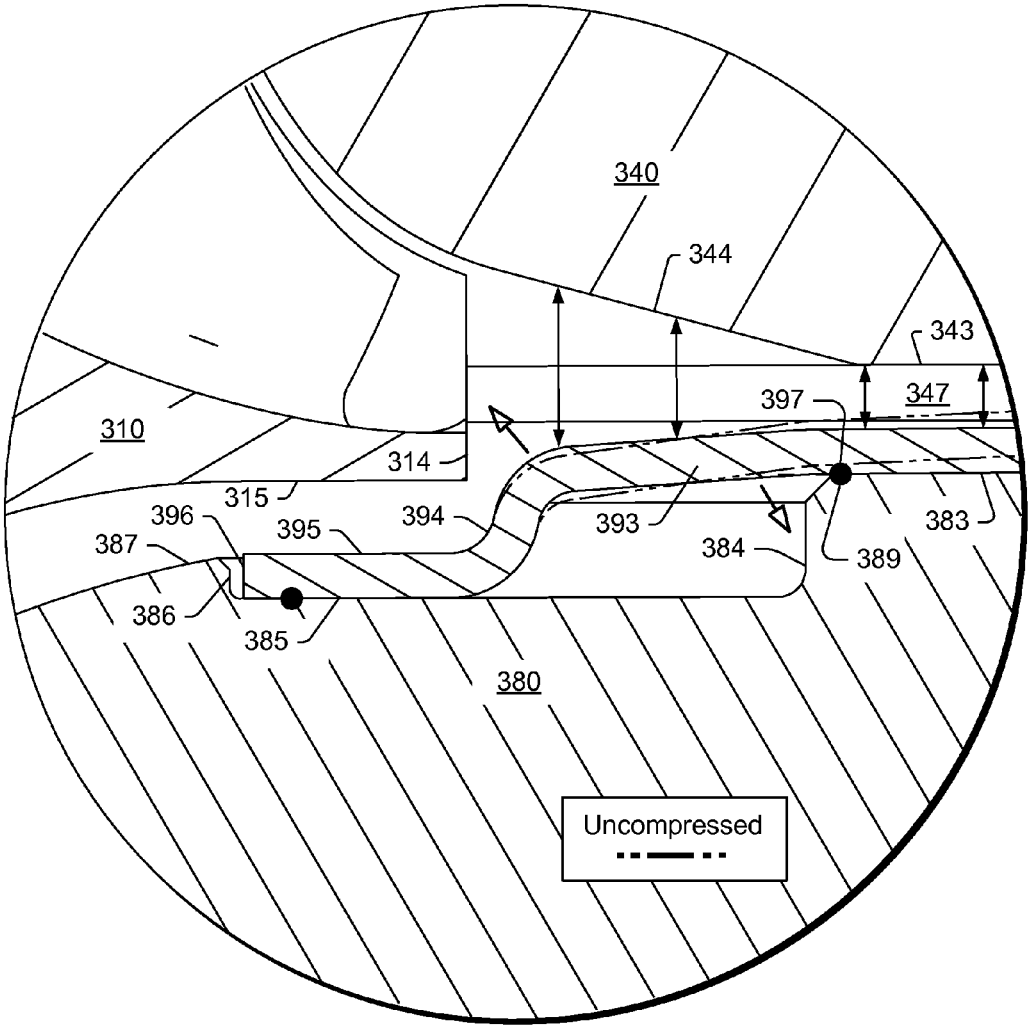
FIG. 6 is an enlarged cross-sectional view of the portion of FIG. 5.
Figure 7:
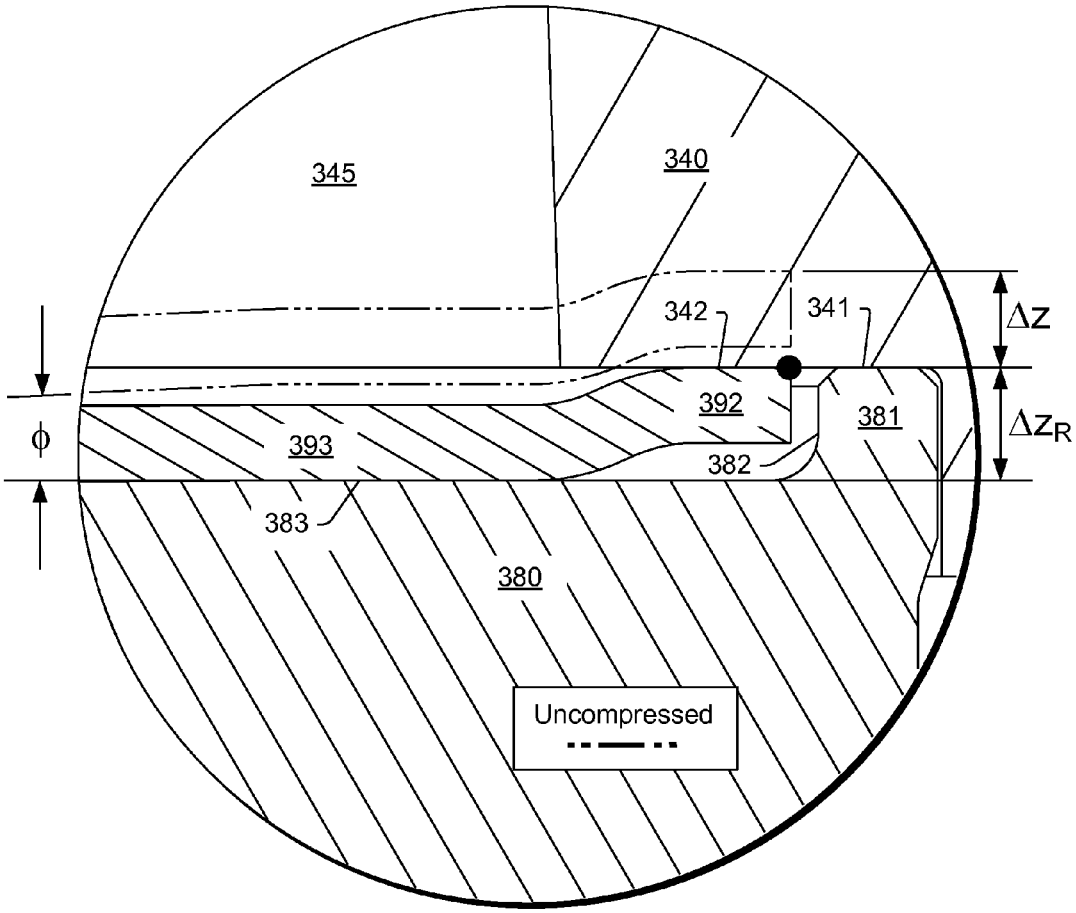
FIG. 7 is another enlarged cross-sectional view of the portion of FIG. 5.

FIG. 5 shows a cross-sectional view of the assembly 300 of FIG. 3 with broken lines that illustrate the plate 390 in an uncompressed state as well as dashed lines to identify portions shown in FIG. 6 and FIG. 7.

FIG. 6 shows a cross-section view of the assembly 300 that includes a portion of the compressor wheel 310. As shown, the compressor wheel 310 includes an outer edge 314 (e.g., disposed at an outer wheel radius) and a lower surface 315 that extends axially upward and radially outward to the outer edge 314. Open arrows indicate changes in shape of a substantially S-shaped portion of the diffuser plate 390 in response to application of force sufficient to change axial height of the plate 390 (e.g., to force the outer edge 391 of the plate 390 axially downward).

In FIG. 6, the housing 340 is shown as having a contoured shroud surface 344 that leads to the surface 343. As described herein, a diffuser may be defined as commencing at a radius of an outer edge of a compressor wheel and terminating at a radius of a volute. Accordingly, for the assembly 300, the diffuser 347 may have an annular portion with decreasing axial height followed by an annular portion of substantially constant axial height that joins a volute. Further, a substantially S-shaped portion of a plate may define a surface of a diffuser, optionally where the S-shape commences its axial rise at a radial distance approximately equal to an outer edge radius of a compressor wheel. In such an example, the S-shape defines a clearance between the plate and the outer edge of a compressor wheel where the clearance may diminish upon compression of the plate (e.g., compare broken lines and solid lines).

In the example of FIG. 6, four vertical arrows indicate axial height of the diffuser 347 as defined by the housing surfaces 343 or 344 and the portion 393 of the plate 390 as it extends radially outward from the transition portion 394 of the plate 390. Also shown in FIG. 6, by a filled circle, is a contact point between a fulcrum 389 of the housing 380 and a fulcrum contact surface 397 of the plate 390. As indicated by the broken lines, some compression of the plate 390 can occur before the plate 390 contacts the fulcrum 389. Further, another contact point is indicated by a solid circle where the lower annular surface 385 of the housing 380 and the lower annular section 395 of the plate 390 contact. Also shown in the example of FIG. 6 is a clearance that exists between the inner edge 386 of the recess of the housing 380 and the inner edge 396 of the plate 390. As mentioned, this clearance may change slightly upon compression of the plate 390 (e.g., responsive to a change in the radius of the inner edge 396).

FIG. 7 shows a cross-section view of the assembly 300 that includes a portion of the compressor housing 340 that defines an outer surface of the volute 345. In the example of FIG. 7, the housing 340 includes a surface 341 that contacts the annular ridge 381 of the housing 380 and a surface 342 that contacts the raised annular section 392 of the plate 390. During assembly, contact occurs between the surface 342 and the raised annular section 392 prior to contact between the surface 341 and the annular ridge 381. As described herein, the surface 342 of the housing 340 and the lower annular surface 385 of the housing 380 may be referred to as clamping surfaces.

FIG. 7 shows various dimensions, including an angle ϕ and axial dimensions Δz and $\Delta z_R$. The angle ϕ represents an angular displacement of a lower surface of the plate 390 that occurs upon compression while the dimension Δz represents an axial displacement of an upper surface of the plate 390 that occurs upon compression, which may be generally about a few degrees (e.g., optionally about five degrees or less). The dimension $\Delta z_R$ can represent a recess depth or height of the annular ridge 381 of the housing 380 or both.

As described herein, a section of a diffuser plate (e.g., a raised annular section) may contact a housing component proximate to a volute to provide for sealing of the volute. For example, as shown in FIG. 7, the diffuser plate 390 applies an upward biasing force against the surface 342 which may form a seal to help seal the volute 345 and thereby prevent leakage of high pressure fluid through a juncture between the surface 341 of the housing 340 and the outer ridge 381 of the housing 380. Further, as described herein, a seal formed by a diffuser plate may help prevent fluid from contacting at least a portion of a housing component. For example, as shown in FIG. 7, upon formation of a seal between the raised annular section 392 and the surface 342, the seal hinders passage of fluid from the volute 345 to an air gap or pocket (e.g., as defined by the housing 340, the housing 380 and the plate 390).

As described herein, a diffuser plate can include a transition section, defined along an axis, from a lower axial portion to a higher axial portion. As shown in various examples, the transition section may have substantially an S-shape or be a sloped annular step. As described herein, deformation characteristics of a diffuser plate may be optimized to obtain a desired diffuser width under a given clamping load. For example, where a torque is specified for bolts that join a compressor housing to a center housing (or other component), a diffuser plate may be configured based at least in part on the torque such that a diffuser is formed with specified characteristics (e.g., width, height, shape, etc.). Further, as described herein, such a torque for a bolt or other joining element may optionally be determined at least in part on stiffness of a diffuser plate. Accordingly, an optimization process may be implemented to determine a bolting load to achieve a clamping load for a diffuser plate that properly shapes the diffuser plate and that properly provides for one or more seals.

As to seals, as described herein, a diffuser plate can be configured to provide for radial contact at an inner and an outer location via appropriately shaped sections. For example, as shown in FIG. 7, the raised annular section 392 provides for formation of a seal with a surface of the housing 340 while, as shown in FIG. 6, the lower annular section 395 provide for formation of a seal with a surface of the housing 380. Given such seals, at least a portion of the housing 380 is protected from contact with gas entering the housing 340. Specifically, a surface of a backplate or backplate portion of a component (e.g., housing 380) can be protected by a diffuser plate seals to thereby avoid corrosion, fouling, etc., of the surface.

As described herein, a diffuser plate may be constructed to avoid excitation by high frequency vibrations. For example, modeling and simulation may be performed for a diffuser plate clamped between two components. Such modeling and simulation may account for any of a variety of sources of vibration. For example, vibrations emanating from a bearing system, a turbine wheel, a compressor wheel, flow over one or more surfaces, etc., may be considered to determine whether characteristics of a diffuser plate are suitable to avoid detrimental excitation. Further, should some excitation exist, as described herein, characteristics of an installed diffuser plate may be sufficient to ensure mechanical integrity during operation.

Figure 8:
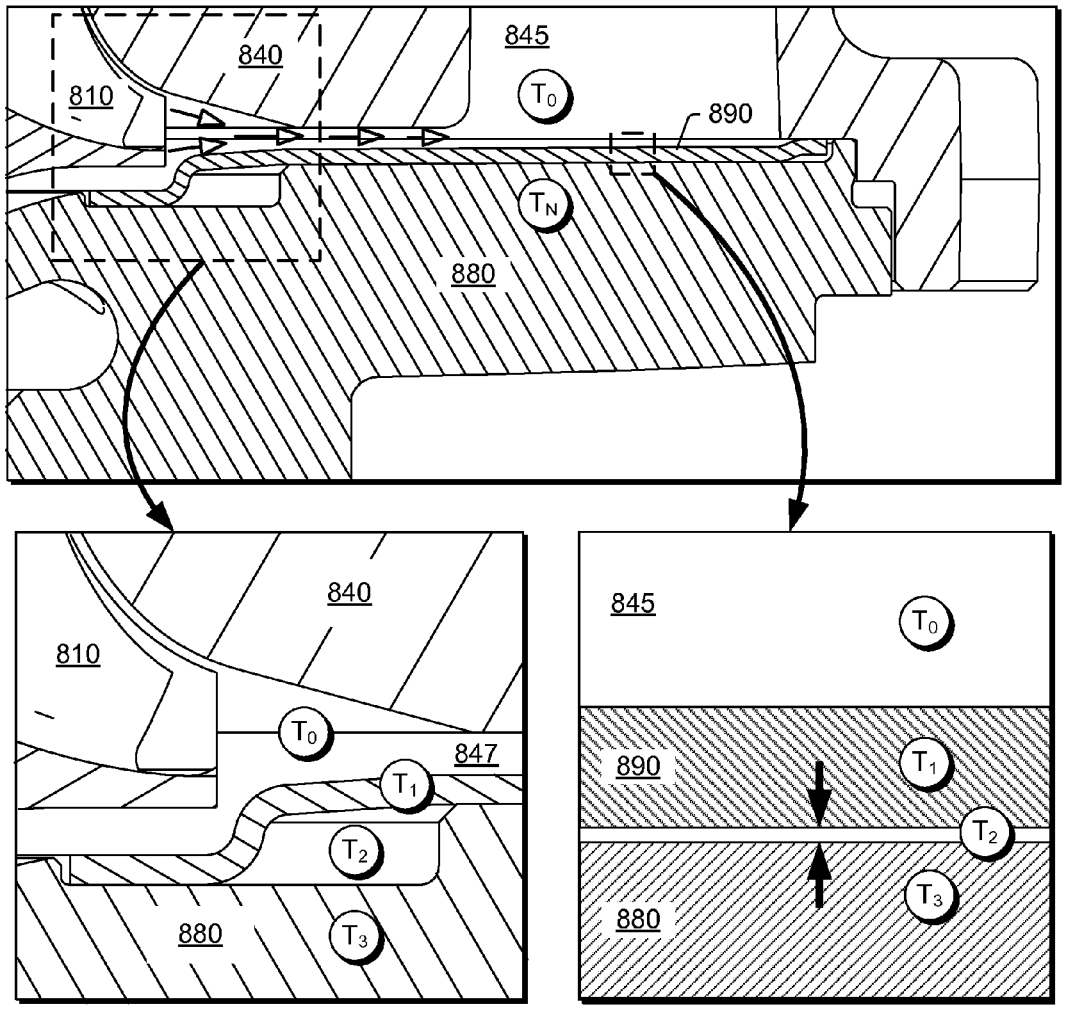
FIG. 8 is a series of views of an example of an assembly that includes one or more gaps or pockets defined in part by a diffuser plate.

FIG. 8 shows various cross-sectional views of a portion of an assembly that includes a compressor wheel 810, a compressor housing 840, a center housing 880 and a deformable diffuser plate 890. Open-headed arrows indicate a general direction of flow as well as diminishing velocity for fluid in a diffuser 847. Heat transfer in such an assembly may be characterized, in part, by Nusselt numbers, Prandtl numbers, Reynolds numbers, etc. Further, as mentioned, a diffuser plate may provide for one or more fluid gaps or pockets. Such gaps or pockets may be filled with air upon assembly and sealed to such an extent to generally exclude any fluid entering a compressor during operation. For example, where a diffuser plate applies sufficient biasing force at a lower annular section and at a raised annular section, the plate may form seals that act to seal gaps or pockets between the plate an another component. Such seals may be sufficient to hinder intrusion by compressed fluids. Accordingly, where exhaust gas recirculation is employed in a manner that passes exhaust through a compressor, such seals can act to avoid intrusion of potentially damaging exhaust constituents into gaps or pockets.

As described herein, a diffuser plate may optionally provide for beneficial heat transfer characteristics. As mentioned, heat energy may be transferred to fluid passing through a compressor and thereby diminish compressor efficiency (e.g., by heating the fluid). FIG. 7 shows various temperatures as well as an approximate heat transfer equation, which may be used to estimate some aspects of heat transfer in an assembly that includes a diffuser plate.

In the examples of FIG. 7, the temperatures may be steady-state operational temperatures with $T_3>T_2>>T_0$. In these examples, T2 represents temperature of a fluid gap or pocket located between the plate 390 and the housing 880. In general, such a fluid gap or pocket acts to hinder heat transfer (i.e., acts to insulate) as, for example, a fluid such as air has a thermal conductivity much less than a metal such as iron, steel, or aluminum. Consider air as having a thermal conductivity of about 0.025 W/(m K) and stainless steel as having a thermal conductivity of about 10 to about 50 W/(m·K). As described herein, a diffuser plate may optionally be constructed from a material with a relatively low thermal conductivity and may optionally be constructed from a material with sufficient integrity and having internal fluid or vacuum pockets that reduce its thermal conductivity. Yet further, as described herein, a diffuser plate may be treated (e.g., coated or other treatment) in a manner that reduces thermal conductivity of the plate.

Figure 9:
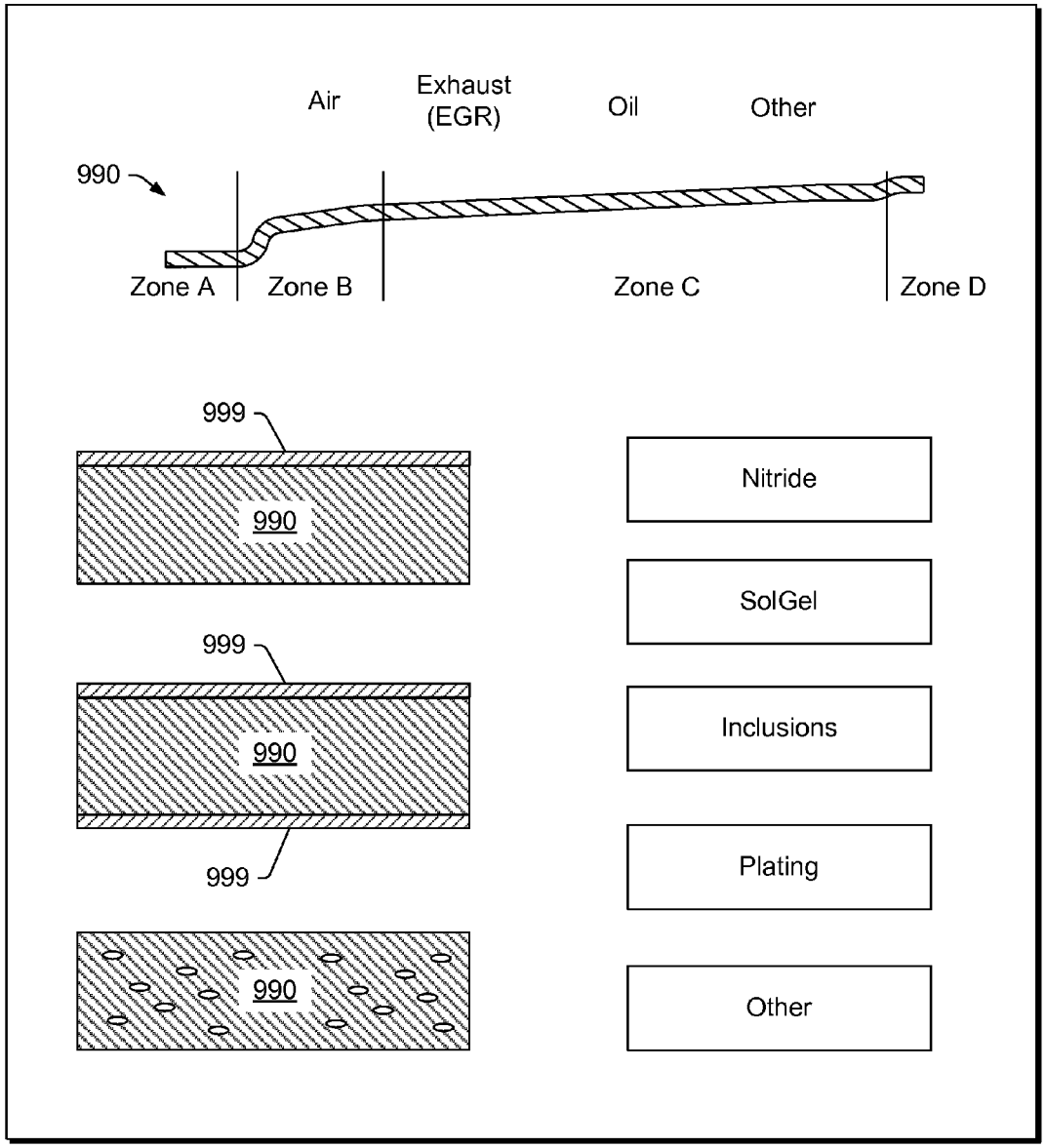
FIG. 9 is a cross-section view of an example of a diffuser plate and various zones along with some examples of treatments or manufacturing techniques.

FIG. 9 shows some examples of treatments or manufacturing techniques for a diffuser plate 990. In the example of FIG. 9, the plate 990 is defines as having four zones: A, B, C and D. Zone A may be a contact zone along a lower surface while Zone D may be a contact zone along an upper surface. As described herein, such surfaces or zones may be treated or manufactured in a manner to provide for beneficial characteristics. As mentioned, a plate may act to form seals with one or more other components. Accordingly, the Zones A and D may be treated for material compatibility that enhances sealing. For example, where the material of construction of the plate 990 differs from that of a compressor housing or a center housing, galvanic corrosion may occur. In such an example, one or more of the surfaces in these zones may be treated to resist galvanic corrosion.

Further, where thermal expansion coefficients differ between two or more components of a compressor assembly, some frictional force may act abrasively at points of contact (e.g., also consider a fulcrum as a point of contact). Accordingly, a diffuser plate may be treated, or alternatively or additionally, one or more other contacting components may be treated (e.g., consider treatment of a portion of a center housing and treatment of a portion of a compressor housing where they contact a diffuser plate).

As mentioned, where exhaust gas recirculation or even where environmental conditions introduce damaging constituents into a compressor, it can be desirable to take measures to avoid damage to a center housing of a turbocharger. For example, a diffuser plate may be relatively inexpensive and readily replaceable when compared to expense of a center housing and replacement of a center housing. Thus, where environmental or operational conditions raise risk of damage to a center housing, a diffuser plate that acts to seal at least a portion (e.g., a diffuser portion) of a center housing can be quite beneficial.

As described herein, a diffuser plate may include one or more treated surfaces that provide anti-fouling properties. For example, where contaminants are hydrophobic, a treatment may provide for a more hydrophilic surface that repels such contaminants. In general, contaminants deposited on a diffuser surface can be detrimental to operational efficiency of a compressor (e.g., due to interference with fluid flow, heat transfer, etc.). Accordingly, at least an outwardly facing surface of a diffuser plate may be treated for anti-fouling. For example, upper surfaces of Zone B and Zone C (e.g., diffuser surface zones) may be treated to impart anti-fouling properties.

FIG. 9 also shows some approximate cross-sections of the diffuser plate 990 as including a layer 999 or layers 999 as well as inclusions. As to treatments or manufacturing processes for a diffuser plate, these may include a nitride treatment, a sol-gel treatment, an inclusion manufacturing process, plating, or one or more others.

As described herein, a diffuser plate may be manufactured from stainless steel and have a "super" finish that can optionally alleviate a need for any additional coating. A super finishing process may provide for beneficial nanoscale surface characteristics (e.g., a so-called nano finishing or polishing process). Such finishing may provide a highly mirrored surface with anti-fouling properties.

Figure 10:
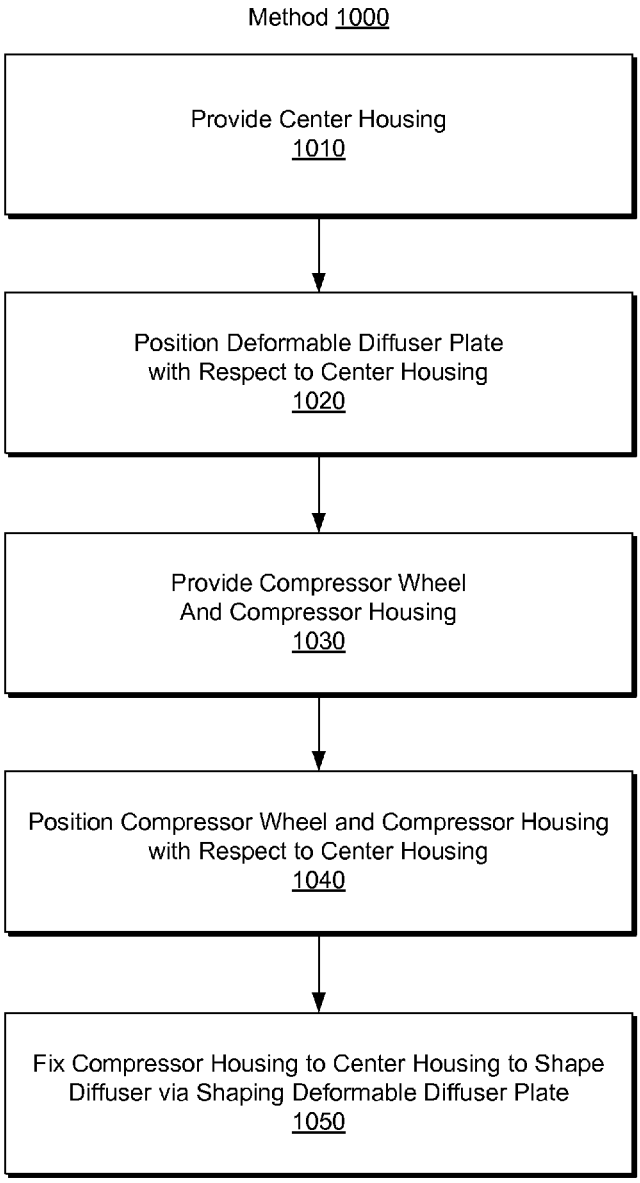
FIG. 10 is a block diagram of a method that includes deforming a deformable diffuser plate.

FIG. 10 shows a block diagram of an example of a method 1000. As shown, the method 1000 includes a provision block 1010 for providing a center housing, a positioning block 1020 for positioning a deformable diffuser plate with respect to the center housing, a provision block 1030 for providing a compressor wheel and a compressor housing, a positioning block 1040 for positioning the compressor wheel and the compressor housing with respect to the center housing and the plate, and a fixation block 1050 for fixing the compressor housing to the center housing to shape a diffuser via shaping the deformable diffuser plate.

Further, as described herein, a deformable diffuser plate may be provided and installed with requiring any additional components other than, for example, conventional components for attaching a compressor housing to a center housing. In such an example, attaching the compressor housing to the center housing locks the diffuser plate therebetween. In such an arrangement, biasing force exerted by the plate may act to maintain the position of the plate during operation and non-operation.

As described herein, a diffuser plate for a centrifugal compressor can include an inner edge disposed at an inner diameter about a central axis; an outer edge disposed at an outer diameter, the outer edge displaced an axial distance from the inner edge; a deformable section with a substantially S-shaped cross-section, the deformable section disposed between the inner edge and the outer edge; and a spring constant for forced axial displacement of the outer edge with respect to the inner edge, the spring constant characterized, at least in part, by the deformable section. Such a plate may further include an axially stepped annular section disposed adjacent to the outer edge.

As described herein, a diffuser plate can include a fulcrum contact surface disposed between an inner edge and an outer edge, for example, where the fulcrum contact surface includes a fulcrum contact surface diameter. Such a plate can be configured for free deformation responsive to application of force to displace the outer edge with respect to the inner edge and configured for deformation about the fulcrum contact surface responsive to application of force to displace the outer edge with respect to the inner edge.

As described herein, a deformable section can be configured to form an annular countered surface of a diffuser of a centrifugal compressor assembly upon application of force to displace the outer edge with respect to the inner edge.

As described herein, a diffuser plate can include an anti-fouling surface treatment, for example, where the anti-fouling surface treatment resists fouling of the diffuser plate by one or more constituents in exhaust of an internal combustion engine or one or more reaction constituents of exhaust of an internal combustion engine. As explained, an anti-fouling surface treatment or other treatment may exist over only a portion of a diffuser plate.

As described herein, a compressor assembly can include a diffuser plate that includes an inner edge disposed at an inner diameter about a central axis and an outer edge disposed at an outer diameter, the outer edge displaced an axial distance from the inner edge; a first housing component that includes a fulcrum disposed at a fulcrum diameter about a central axis, the fulcrum diameter greater than the inner diameter of the inner edge and less than the outer diameter of the outer edge of the diffuser plate; and a second housing component that includes a clamping surface where the clamping surface has an inner dimension less than the outer diameter of the outer edge of the diffuser plate, where, for a clamped configuration of the diffuser plate, the diffuser plate applies a biasing force between the fulcrum of the first housing component and the clamping surface of the second housing component. In such an example, the diffuser plate can have one or more spring constants. Further, such a plate can include a fulcrum contact surface.

As to clamping, a clamping surface can extend radially outwardly from a surface of a housing that defines, at least in part, a volute. As described herein, a deformable diffuser plate, for the clamped configuration, can include a deformed surface that defines, in part, shape of a diffuser.

As described herein, a diffuser plate can optionally include at least one surface treated with a treatment selected from, for example, an anti-fouling treatment, a heat transfer treatment, a flow modification treatment, and a corrosion resistant treatment.

As described herein, a method can include positioning a deformable diffuser plate for a centrifugal compressor between a first housing component and a second housing component; forcing the first housing component to the second housing component against a biasing force applied by the deformable diffuser plate; and, responsive to the forcing, deforming the deformable diffuser plate to shape a surface of a diffuser of the centrifugal compressor. In such a method, the first housing component and the second housing component may be a compressor housing and a center housing and where the diffuser plate provides for an air gap between the compressor housing and the center housing. As described herein, a method can include deforming a diffuser plate, for example, such as one or more of freely deforming and deforming against a fulcrum.

As described herein, various acts may be performed by a controller (see, e.g., the controller 190 of FIG. 1), which may be a programmable control configured to operate according to instructions. As described herein, one or more computer-readable media may include processor-executable instructions to instruct a computer (e.g., controller or other computing device) to perform one or more acts described herein. A computer-readable medium may be a storage medium (e.g., a device such as a memory chip, memory card, storage disk, etc.). A controller may be able to access such a storage medium (e.g., via a wired or wireless interface) and load information (e.g., instructions and/or other information) into memory (see, e.g., the memory 194 of FIG. 1). As described herein, a controller may be an engine control unit (ECU) or other control unit. Such a controller may optionally be programmed to control lubricant flow to a turbocharger, lubricant temperature, lubricant pressure, lubricant filtering, exhaust gas recirculation, etc.

Although some examples of methods, devices, systems, arrangements, etc., have been illustrated in the accompanying Drawings and described in the foregoing Detailed Description, it will be understood that the example embodiments disclosed are not limiting, but are capable of numerous rearrangements, modifications and substitutions without departing from the spirit set forth and defined by the following claims.

What is claimed is:

1. A method for deforming a diffuser plate for a centrifugal compressor of a turbocharger, the method comprising:

providing the diffuser plate wherein the diffuser plate comprises an inner edge disposed at an inner diameter about a central axis, a lower annular surface that extends radially outwardly to a transition section that comprises a fulcrum contact surface, an upper annular surface and an outer edge disposed at an outer diameter, the outer edge displaced an undeformed axial distance from the inner edge;

positioning the diffuser plate between a first housing component and a second housing component such that the lower annular surface of the diffuser plate contacts a clamping surface of the first housing component, the fulcrum contact surface of the diffuser plate contacts a fulcrum of the first housing component, and the upper annular surface of the diffuser plate contacts a clamping surface of the second housing component;

forcing the first housing component to the second housing component against a biasing force applied by the diffuser plate; and responsive to the forcing, deforming the diffuser plate to shape a surface of a diffuser of the centrifugal compressor and to displace the outer edge of the diffuser plate a deformed axial distance from the inner edge of the diffuser plate wherein the deformed axial distance is less than the undeformed axial distance.

2. The method of claim 1 wherein the first housing component and the second housing component comprise a compressor housing and a center housing and wherein the diffuser plate provides for an air gap between the compressor housing and the center housing.

3. The method of claim 1 wherein the deforming comprises freely deforming and deforming against a fulcrum.

4. A diffuser plate for a centrifugal compressor of a turbocharger, the diffuser plate comprising:

an inner edge disposed at an inner diameter about a central axis;

an outer edge disposed at an outer diameter, the outer edge displaced an axial distance from the inner edge;

a lower annular section that extends radially outwardly from the inner edge and that comprises a lower annular contact surface;

an upper annular section that extends radially outwardly to the outer edge and that comprises an upper annular contact surface;

a deformable section that extends from the lower annular section and that comprises a substantially S-shaped cross-section and a fulcrum contact surface, the deformable section disposed between the lower annular section and the upper annular section; and a spring constant for forced axial displacement of the upper annular surface with respect to the fulcrum contact surface that deforms the deformable section and that decreases the axial distance between the outer edge and the inner edge.

5. The diffuser plate of claim 4 wherein the fulcrum contact surface comprises a fulcrum contact surface diameter.

6. The diffuser plate of claim 4 configured for free deformation responsive to application of force to displace the outer edge with respect to the inner edge and configured for deformation about the fulcrum contact surface responsive to application of force to displace the outer edge with respect to the inner edge.

7. The diffuser plate of claim 4 wherein the deformable section comprises a deformable section configured to form an annular countered surface of a diffuser of a centrifugal compressor assembly upon application of force to displace the outer edge with respect to the inner edge.

8. The diffuser plate of claim 4 further comprising an anti-fouling surface treatment.

9. The diffuser plate of claim 8 wherein the anti-fouling surface treatment resists fouling of the diffuser plate by one or more components in exhaust of an internal combustion engine or one or more reaction components of exhaust of an internal combustion engine wherein the exhaust comprises exhaust gas recirculation exhaust.

10. The diffuser plate of claim 8 wherein the anti-fouling surface treatment exists over only a portion of the diffuser plate.

11. A compressor assembly comprising:

a diffuser plate that comprises an inner edge disposed at an inner diameter about a central axis, a lower annular surface that extends radially outwardly to a transition section that comprises a fulcrum contact surface, an upper annular surface and an outer edge disposed at an outer diameter, the outer edge displaced an axial distance from the inner edge;

a first housing component that comprises a clamping surface and a fulcrum disposed at a fulcrum diameter about a central axis, the fulcrum diameter greater than the inner diameter of the inner edge and less than the outer diameter of the outer edge of the diffuser plate; and a second housing component that comprises a clamping surface wherein the clamping surface comprises an inner dimension less than the outer diameter of the outer edge of the diffuser plate, wherein for a clamped configuration of the diffuser plate, the lower annular surface of the diffuser plate contacts the clamping surface of the first housing component, the fulcrum contact surface of the diffuser plate contacts the fulcrum of the first housing component, the upper annular surface of the diffuser plate contacts the clamping surface of the second housing component and the diffuser plate applies a biasing force between the fulcrum of the first housing component and the clamping surface of the second housing component.

12. The compressor assembly of claim 11 wherein the diffuser plate comprises a spring constant.

13. The compressor assembly of claim 11 wherein the first housing comprises a center housing of a turbocharger.

14. The compressor assembly of claim 11 wherein the second housing comprises a compressor housing.

15. The compressor assembly of claim 11 wherein the clamping surface extends radially outwardly from a surface of the second housing that defines, at least in part, a volute.

16. The compressor assembly of claim 11 wherein the diffuser plate comprises a deformable diffuser plate wherein, for the clamped configuration, a deformed surface of the diffuser plate defines, in part, shape of a diffuser.

17. The compressor assembly of claim 11 wherein the diffuser plate comprises at least one surface treated with a treatment selected from a group consisting of an anti-fouling treatment, a heat transfer treatment, a flow modification treatment, and a corrosion resistant treatment.

* * * * *